US005904104A

United States Patent [19]

Yu

[11] Patent Number: 5,904,104

[45] Date of Patent: May 18, 1999

[54] STRUCTURAL IMPROVEMENT OF COMPUTER DESK

[76] Inventor: Ting Chen Yu, No. 24, Ln 342, Ho Ping Rd., I Lan, Taiwan

[21] Appl. No.: 09/054,524

[22] Filed: Apr. 3, 1998

[51] Int. Cl.[6] ..... A47B 3/02

[52] U.S. Cl. ..... 108/116; 108/115; 108/193

[58] Field of Search ..... 108/115, 123, 108/162, 169, 170, 173, 174, 176, 116, 106, 193, 192, 50.01

[56] References Cited

U.S. PATENT DOCUMENTS

| | | | |
|---|---|---|---|
| 3,527,174 | 9/1970 | Lay | 108/115 |
| 4,099,469 | 7/1978 | Sahli | 108/115 X |
| 5,257,701 | 11/1993 | Edelson | 108/116 X |
| 5,315,935 | 5/1994 | Weisenfels | 108/115 X |
| 5,601,038 | 2/1997 | Welch et al. | 108/193 |
| 5,622,119 | 4/1997 | Hsieh | 108/115 |

*Primary Examiner*—Jose V. Chen

*Attorney, Agent, or Firm*—Jacobson, Price, Holman & Stern, PLLC

[57] ABSTRACT

The subject matter relates to a structural improvement of computer desk, or more specifically to a type of computer desk that can be disassembled or collapsed, with sufficient utilization of storage space, with the height of its desk plate adjustable to suit its application at a regular location, in an office or a Japanese-style room. The subject matter comprises mainly a skeleton and no less than one desk plate, wherein on each of two sides of the skeleton is respectively a leg rack that can rotate freely around a radial shaft lever, with a transverse fixing lever to fix the distance between two radial shaft levers; at each of the front of the two sides of the desk plate is respectively an adjustable bolt hook that can be hooked to the adjustable bolt hole on the leg rack, and at its rear side is an arched hook, so designed that the rear side of the desk plate can be hooked onto the transverse fixing lever or the support ladder that corresponds to the adjustable bolt holes, and the front of the desk plate can be hooked with adjustable hooks to a pair of adjustable bolt holes on the leg rack.

3 Claims, 10 Drawing Sheets

STRUCTURAL IMPROVEMENT OF COMPUTER DESK

BACKGROUND OF THE INVENTION

The subject matter relates to a type of structural improvement of a computer desk, or more specifically to one that can be disassembled or collapsed, with sufficient utilization of space, and one on which the desk plate height can be adjusted to suit its use in a regular location, an office or a Japanese-style room.

To boost its structural strength, a regular computer desk is normally made of thick and solid materials; to facilitate transportation, all components have been designed to enable their assembly with screws. Solid and thick wood plates are screwed together to form a computer desk, to assure excellent joining strength between respective components, and to facilitate transportation; but when the user tries to assemble the computer with screws, the user may often be confused by the similar measurements or shapes of the components, resulting in the consumption of an extended time period during the assembling process. In case of delivery to the computer company for servicing purposes, a major cleanup of the house, relocation of house or remodeling, etc. the disassembly of the computer desk may prove quite troublesome.

Furthermore, a computer desk in a Japanese-style room is normally placed on a tatami, therefore, the user's legs cannot stretch to the front. On the other hand, an extended period of sideways leg placement will result in disorders to the spine or bones, and, a computer desk that is not designed for use in a Japanese-style room environment will not be applicable therein; therefore, the conventional type of computer desk requires improvement.

In view of the above shortcomings, the subject inventor has devoted research, based on many years of experiences engaged in the manufacture of computer desks and related appliances and accompanied by technical applications, and has finally presented a reasonably designed subject matter of computer desk structure that is quite different from the prior art, with effective improvement on the two major shortcomings of said conventional computer desk, for which the subject application is filed for. Your favorable consideration shall be appreciated.

SUMMARY OF THE INVENTION

The primary objective of the subject matter is to design a type of computer desk that can be conveniently assembled and collapsed.

The secondary objective of the subject matter is to design a computer desk with sufficient utilization of available space, that can be adjusted to suit the height of the user and the height of the equipment.

To enable your understanding of the main technical contents of the subject matter, the following drawings are described:

Brief Description of Numerals

| | | | |
|---|---|---|---|
| A | fixing screw | B | desktop plate |
| C | desk leg plate | D | placement plate |
| E | box unit | E1 | monitor |
| E2 | keyboard | E3 | PC main unit |
| 1 | skeleton | 11 | leg rack |
| 111 | adjustable bolt holes | 12 | radial shaft rod |
| 121 | fixing hole | 13 | telescopic lever |
| 131 | placement lever | 1311 | placement basket hole |
| 132 | reverted-U piece | 1321 | catch pin |
| 14 | transverse fixing lever | 141 | support ladder |
| 1411 | support step | 2 | desk plate |
| 21 | arched hook | 211 | adjustable plug |
| 22 | adjustable hook | 221 | hook |
| 222 | | 223 | |
| 3 | placement basket | 31 | placement basket hook |

DETAILED DESCRIPTION OF PREFERRED EMBODIMENT

Figure 1:
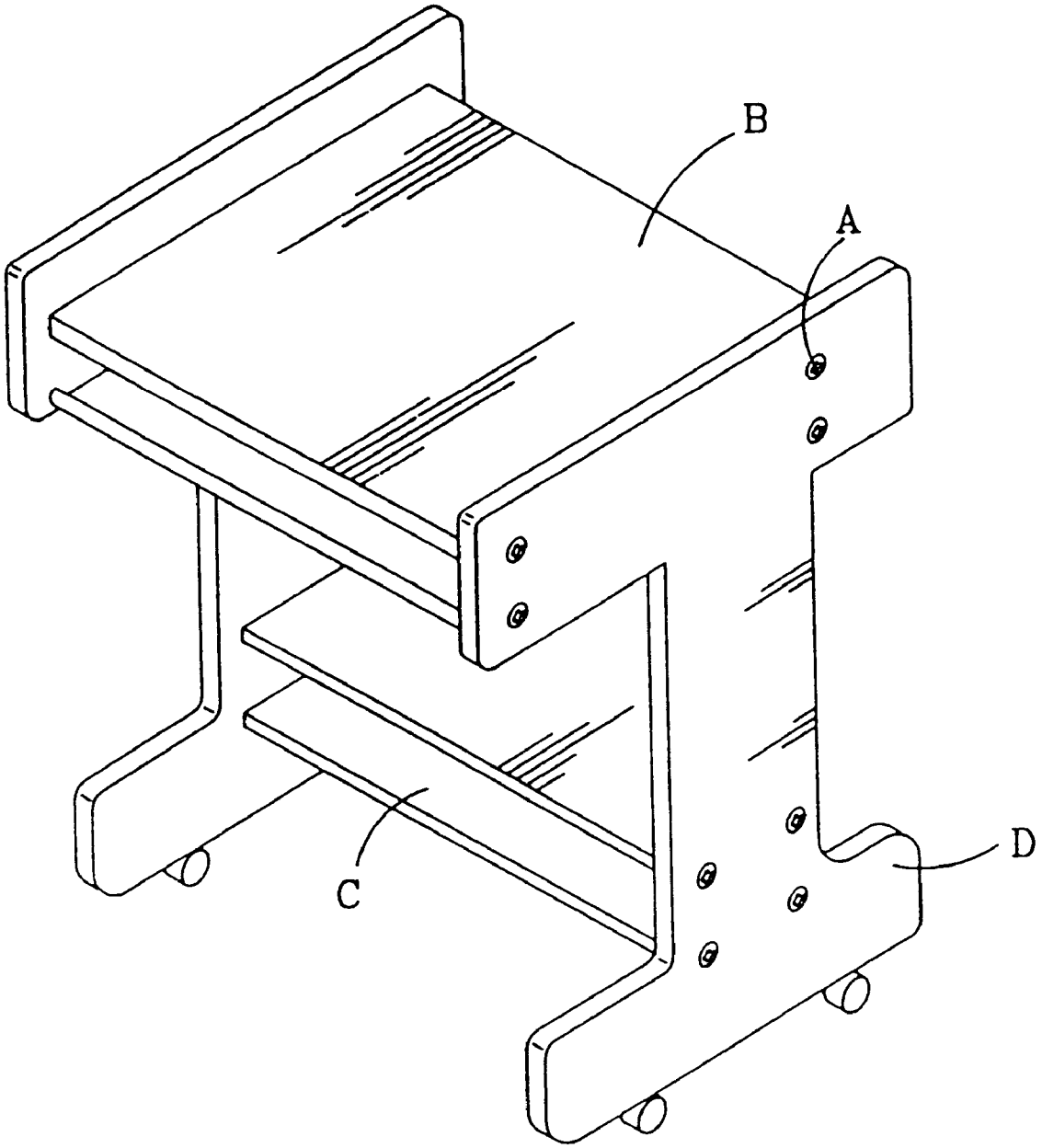
FIG. 1 (PRIOR ART)
FIG. 1 is a perspective view of a prior art of computer desk.

As illustrated in FIG. 1, a prior art of computer desk is normally made by tightening its desktop plate (B) and its placement plate (D) to its desk bottom plate (C) with a number of screws (A), therefore, though a conventional computer desk is assembled by merely tightening the plates with screws (C), its disassembling process or its utilization of limited space will not be as good as the subject matter.

Figure 2:
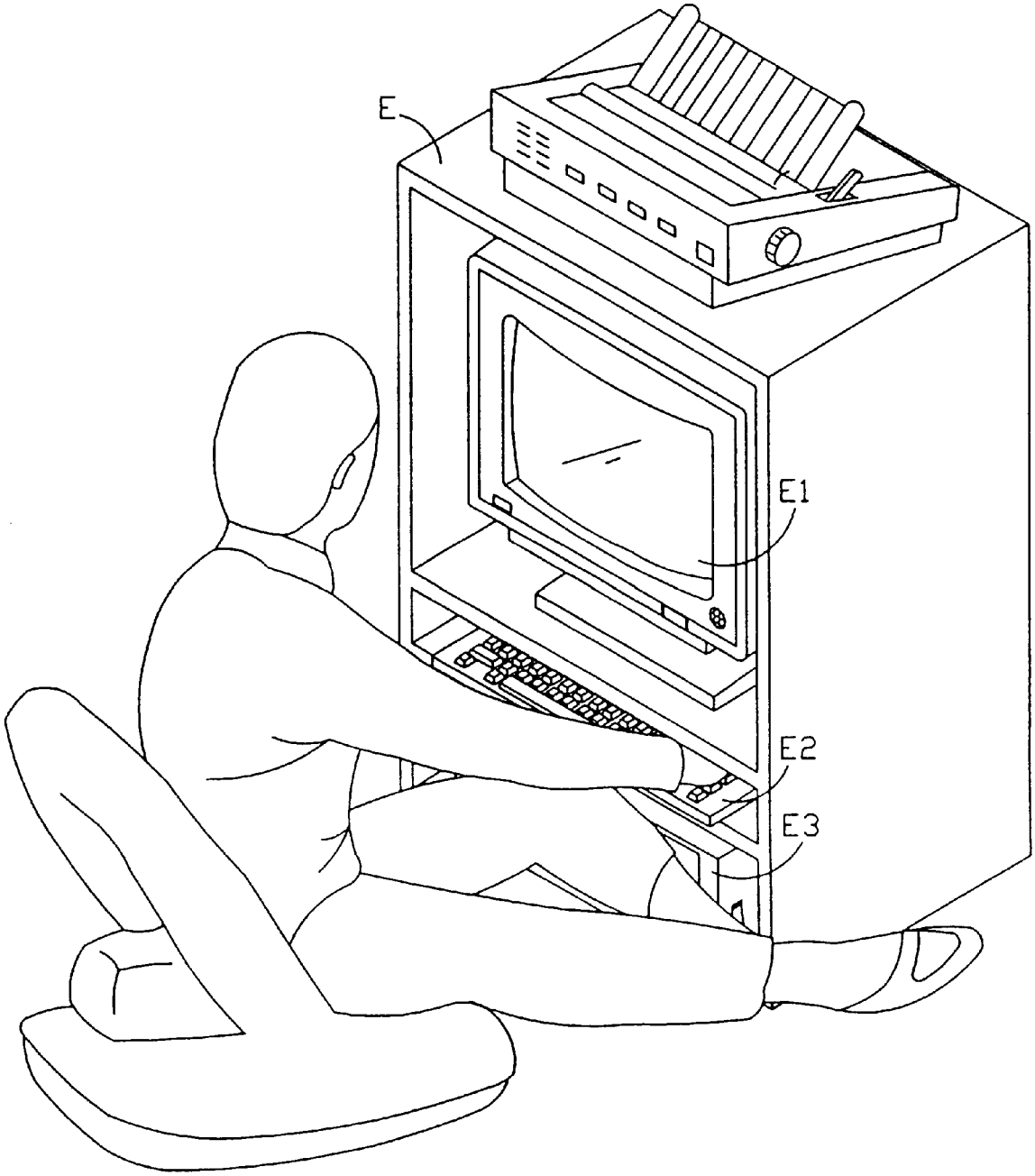
FIG. 2 (PRIOR ART)
FIG. 2 is a perspective view of a prior art of computer desk in a Japanese-style room.

As illustrated in FIG. 2, a prior art of computer desk installed in a Japanese-style room is normally made by dividing the inside large space of a box unit (E) into several smaller spaces, while the computer monitor (E1), the keyboard (E2) and the PC main unit (E3) placed in appropriate spaces; in such a structural design of a computer desk, deleterious to the user's bone structure due to extensive use of the computer desk has been ignored.

Figures 3A, 3B:
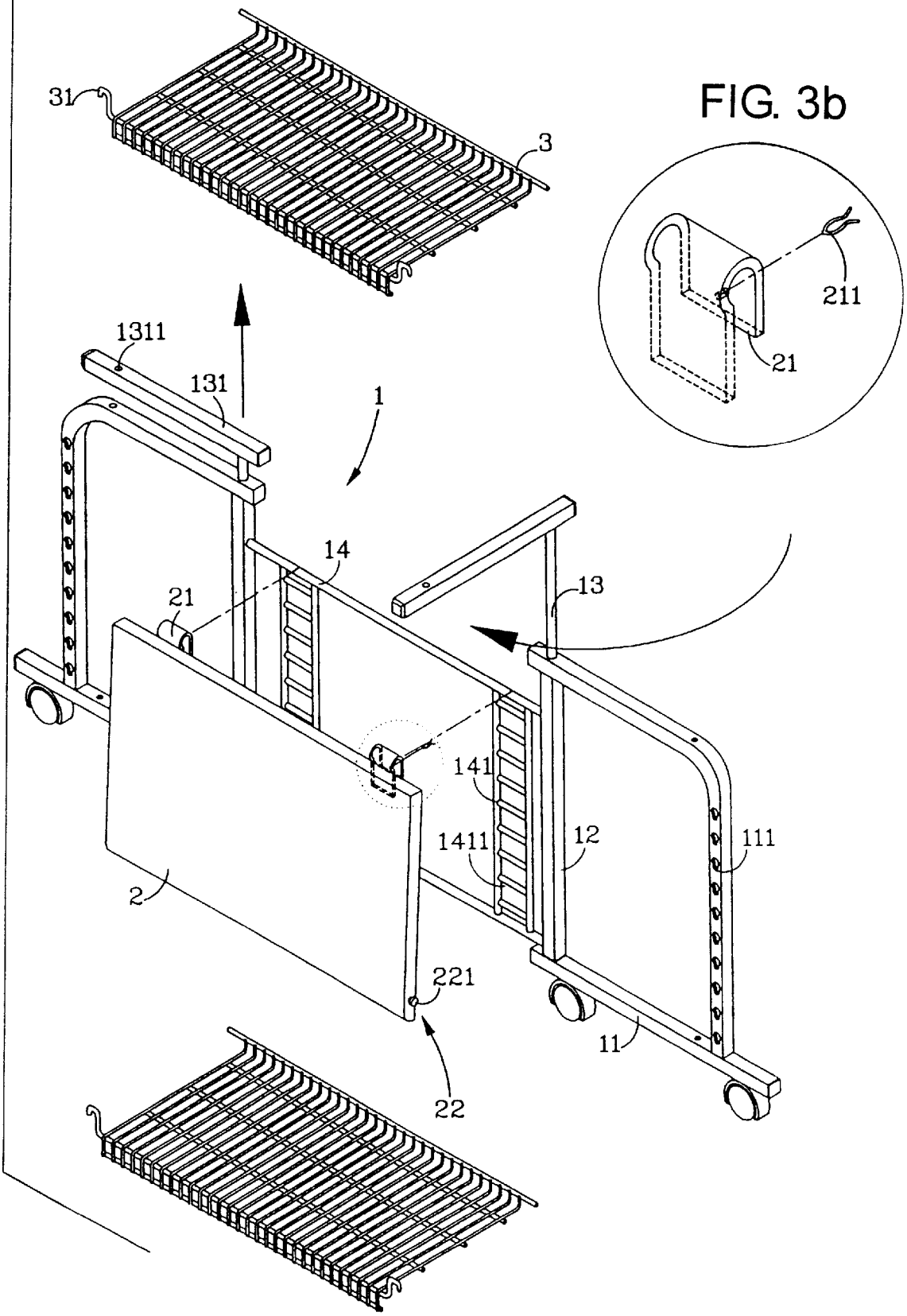
FIGS. 3*a* and 3*b* are a perspective disassembled view of the subject matter and a close-up of a part.
Figure 4:
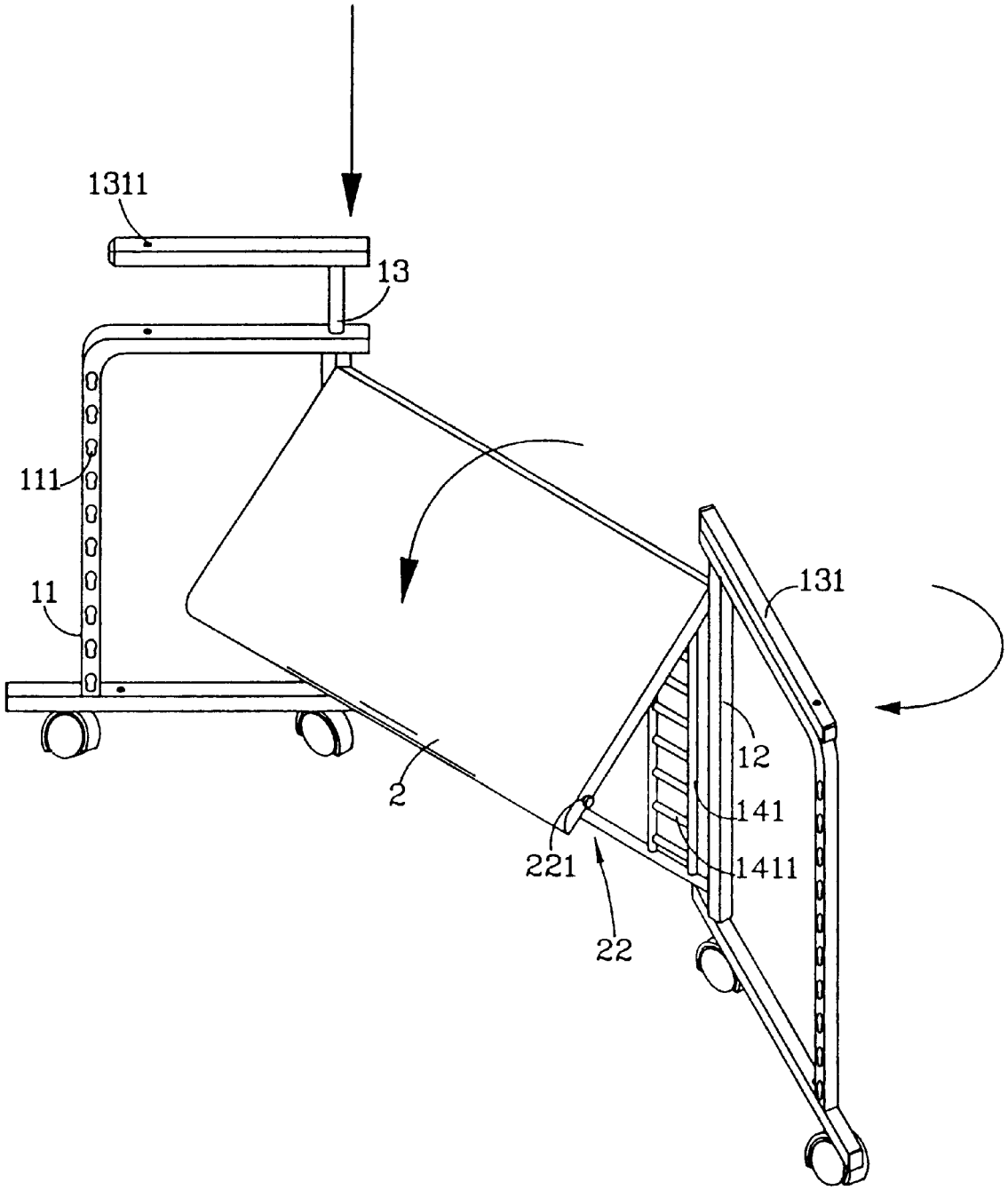
FIG. 4 is a view of the subject matter being assembled.
Figure 5B:
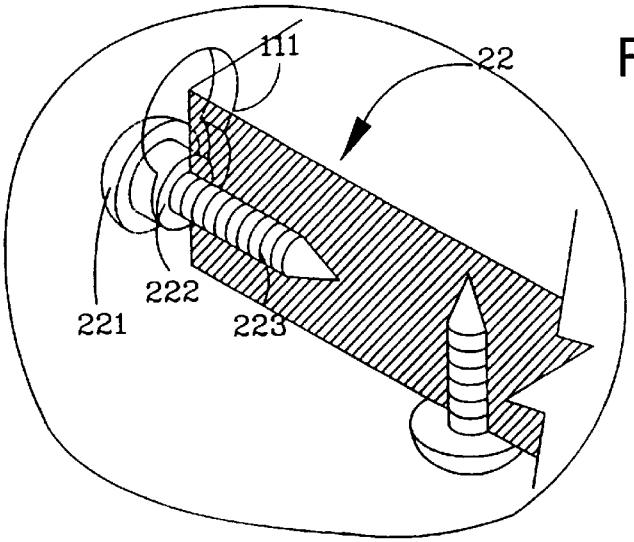
FIGS. 5*a*, 5*b* and 5*c* are views of a portion and close-up of parts of the subject matter.
Figure 5A:
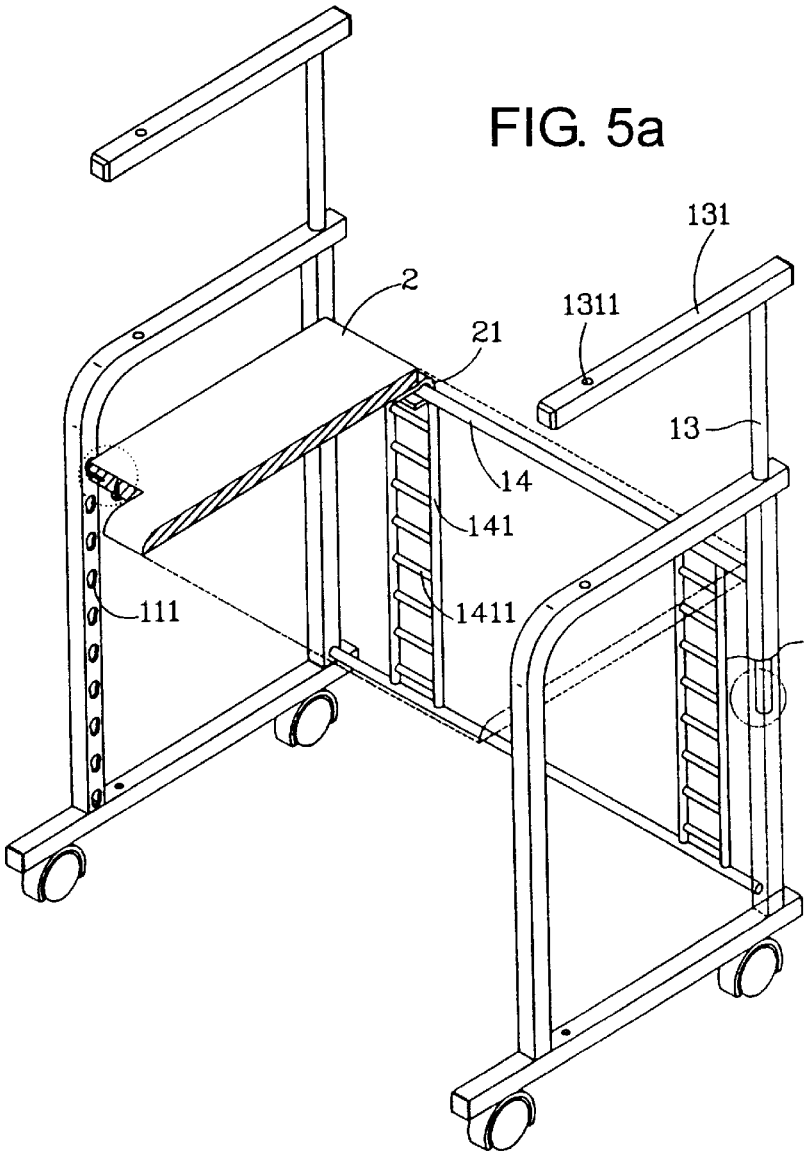
Figure 5C:
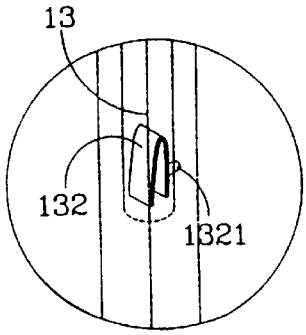

As illustrated in FIGS. 3, 4 and 5, the subject matter comprises mainly a skeleton (1) and a desk plate (2); on each of the left and right sides of the skeleton (1) is respectively a leg rack (11) that is able to rotate freely around the radial shaft lever (12), with a transverse fixing lever (14) that fixes the distance between the two radial shaft levers (12), and on the back of the leg rack are several adjustable bolt holes (111). At each of the left and right sides under the desk plate (2) is respectively an adjustable hook (22) that can be hooked to the adjustable bolt holes (111) on the leg rack (11), and at the rear side of the desk plate (2) is an arched hook (21) that serves to hook the desk plate (2) onto the transverse fixing lever (14) or the support steps (1411) on the support ladder (141), and on the arched hook (21) is an adjustable plug (211) that can be removed and replaced. It is so structured that the desk plate (2) may move around the shaft of the transverse fixing lever (14) before it is hooked onto the adjustable bolt hole (111), and the user may adjust the desired angle of the desktop by adjusting the hooking positions of the arched hook (21) and the adjustable hook (22).

When the subject matter of arched hook (21) is hooked onto the transverse fixing lever (14) or the support steps (1411), the desk plate (2) and the leg rack (11) at two sides will be able to rotate freely, therefore, the adjustable hook (22) can be hooked to the adjustable bolt hole (111) by rotating the desk plate (2) and the leg rack (11); the subject matter of adjustable hook (22) involves a lining (222) at the end of the bolt (223), and when the hook (221) is hooked in the adjustable bolt hole (111), the lining (222) will be directly mounted on the adjustable bolt hole (111) to increase the strength of the bolt (223).

To enable the user to develop creative utilization of the space available, the subject matter has a telescopic lever (13) with a top placement lever (131) in each of the two radial shaft levers (12); by pulling out the two telescopic levers (13), the catch pin (1321) of the reverted-U piece (132) contained inside the telescopic lever (13) is pushed inside the fixing hole (121) by the elastic force of the U piece (132), so the height of the placement lever (131) and the telescopic lever (13) are fixed by the catch pin (1321) which pushes against the fixing hole (121); in case the height of the telescopic lever (13) and the placement lever (131) need to be adjusted, the user need only push the catch pin (1321) away from the interfering scope of the fixing hole (121), then the height of the telescopic (13) and the placement lever (131) can be adjusted accordingly. The placement basket (3) can be adjusted to suit the requirements of the user, to arrange the most appropriate working space, and to achieve the functions of best comfort and fill utilization of space.

Figure 6:
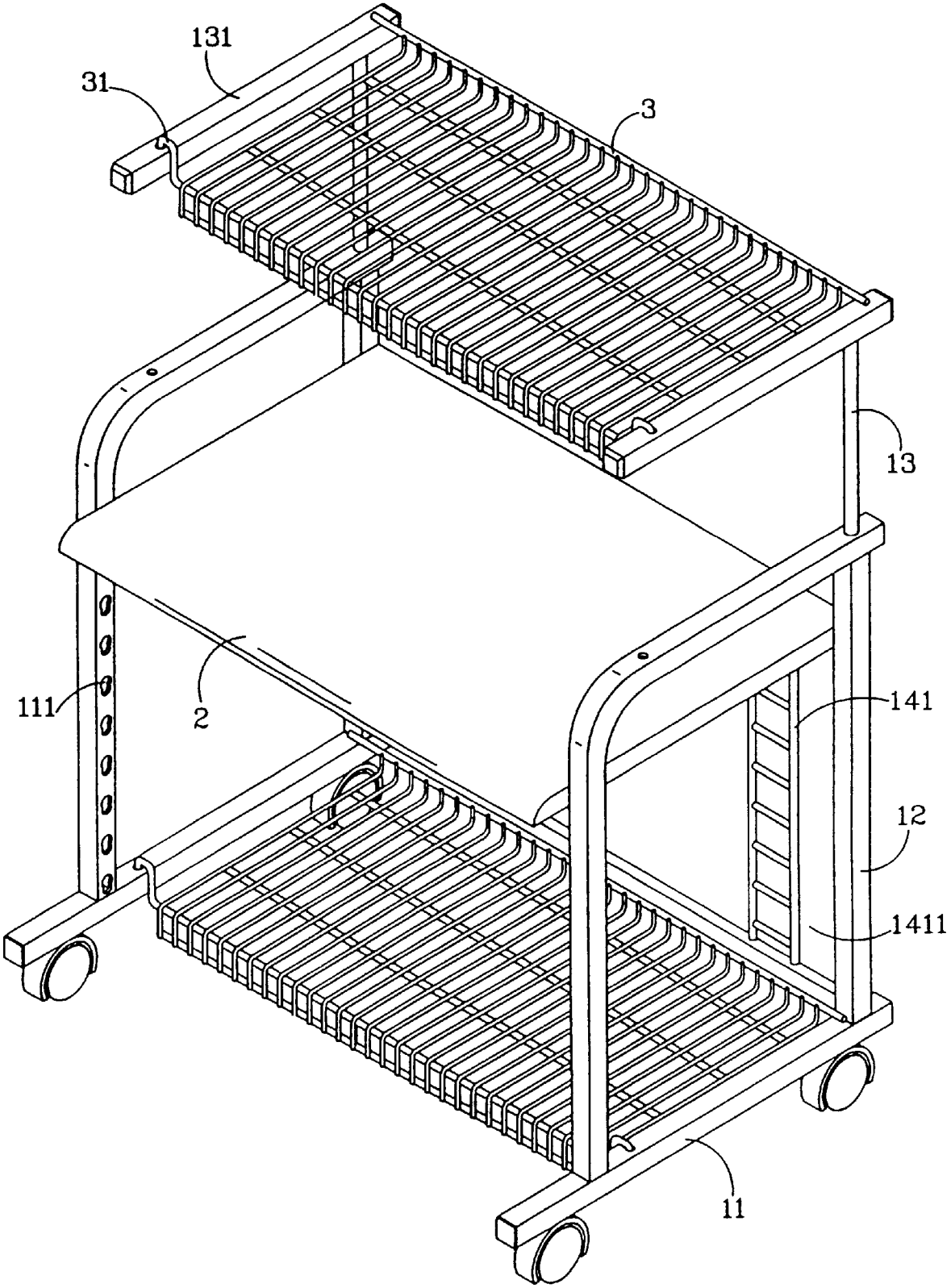
FIG. 6 is a perspective assembled view of the subject matter.

As illustrated in FIG. 6, after the height of the placement lever (131) and the telescopic lever (13) are fixed because the catch pin (1321) of the inverted-U piece (132) is pushed inside the fixing hole (121); if the user puts a placement basket (3) on the placement levers (131), then the placement basket hooks (31) are hooked to the placement basket holes (1311), then the relative position of the two placement levers (131) are fixed, and the two placement levers (131) can be mutually fixed, to avoid movement.

Figure 7:
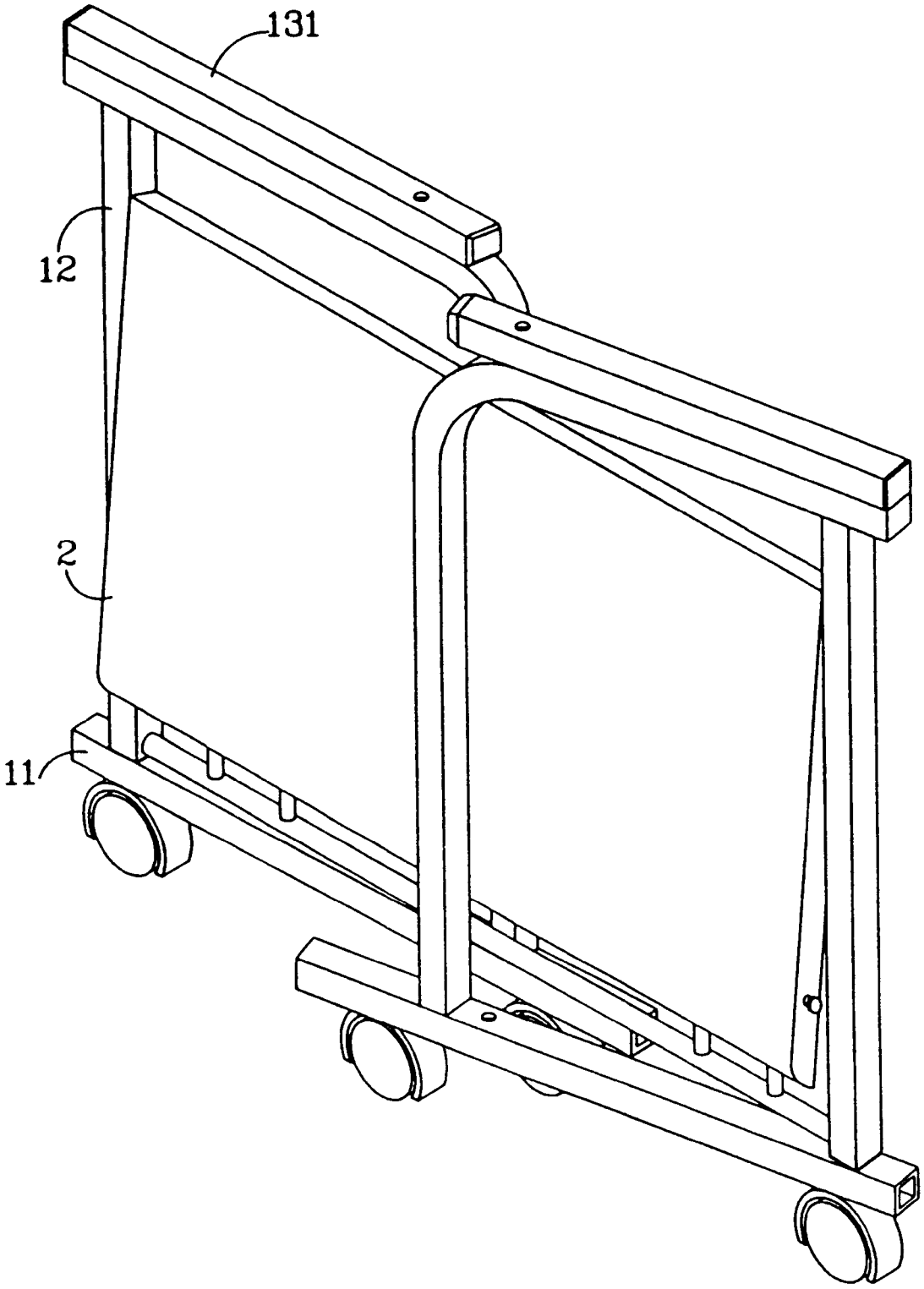
FIG. 7 illustrates an example of the subject matter being folded.
Figure 8:
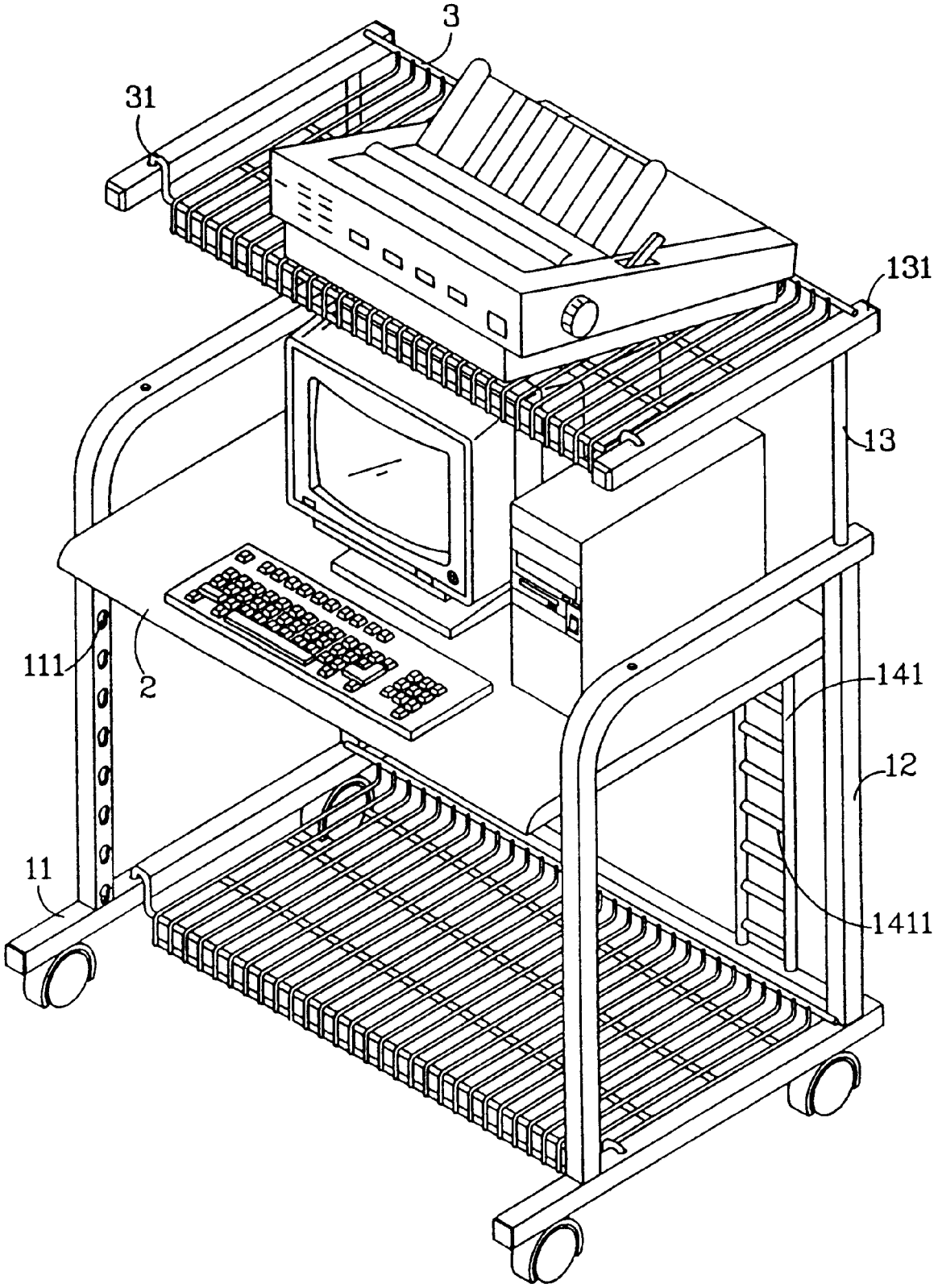
FIG. 8 illustrates a first example of the subject matter in application.

As illustrated in FIGS. 7 and 8, when the subject matter needs to be folded, all the user has to do is to remove the placement basket (131), push the fixing catch pin (132) away from the fixing hole (121), so the placement lever (131) and the telescopic lever (13) are folded into the radial shaft lever (12); after the desk plate (2) is removed, the two leg racks (11) are respectively turned to join the front and rear sides of the skeleton (1), thus to configure one of the preferred folding states of the subject matter.

Figure 9:
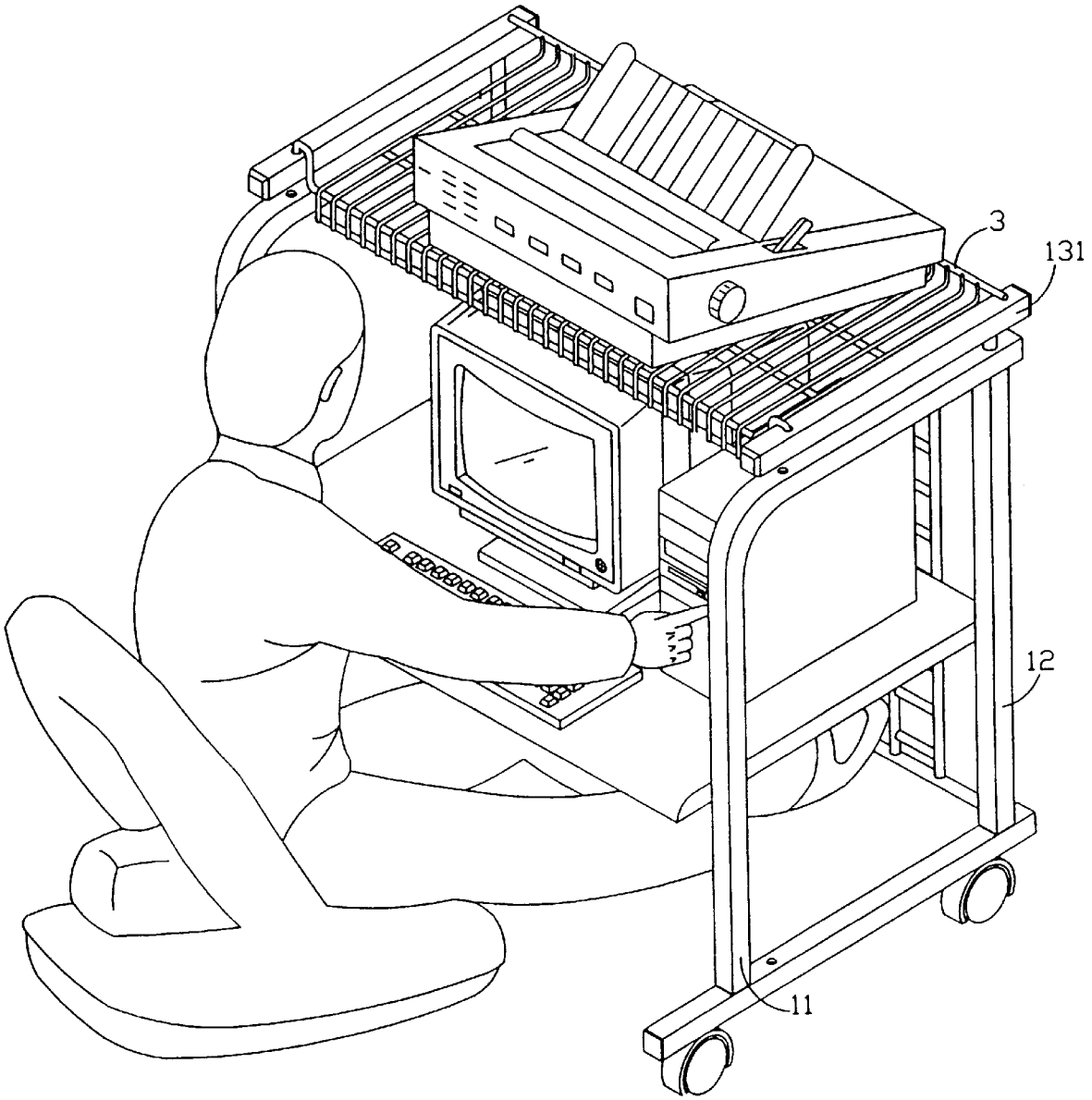
FIG. 9 illustrates a second example of the subject matter in application.

As illustrated in FIG. 9, just by adjusting the height of the desk plate (2) of the subject matter, the subject matter can be used in a Japanese-style room as shown in the drawing.

Figure 10:
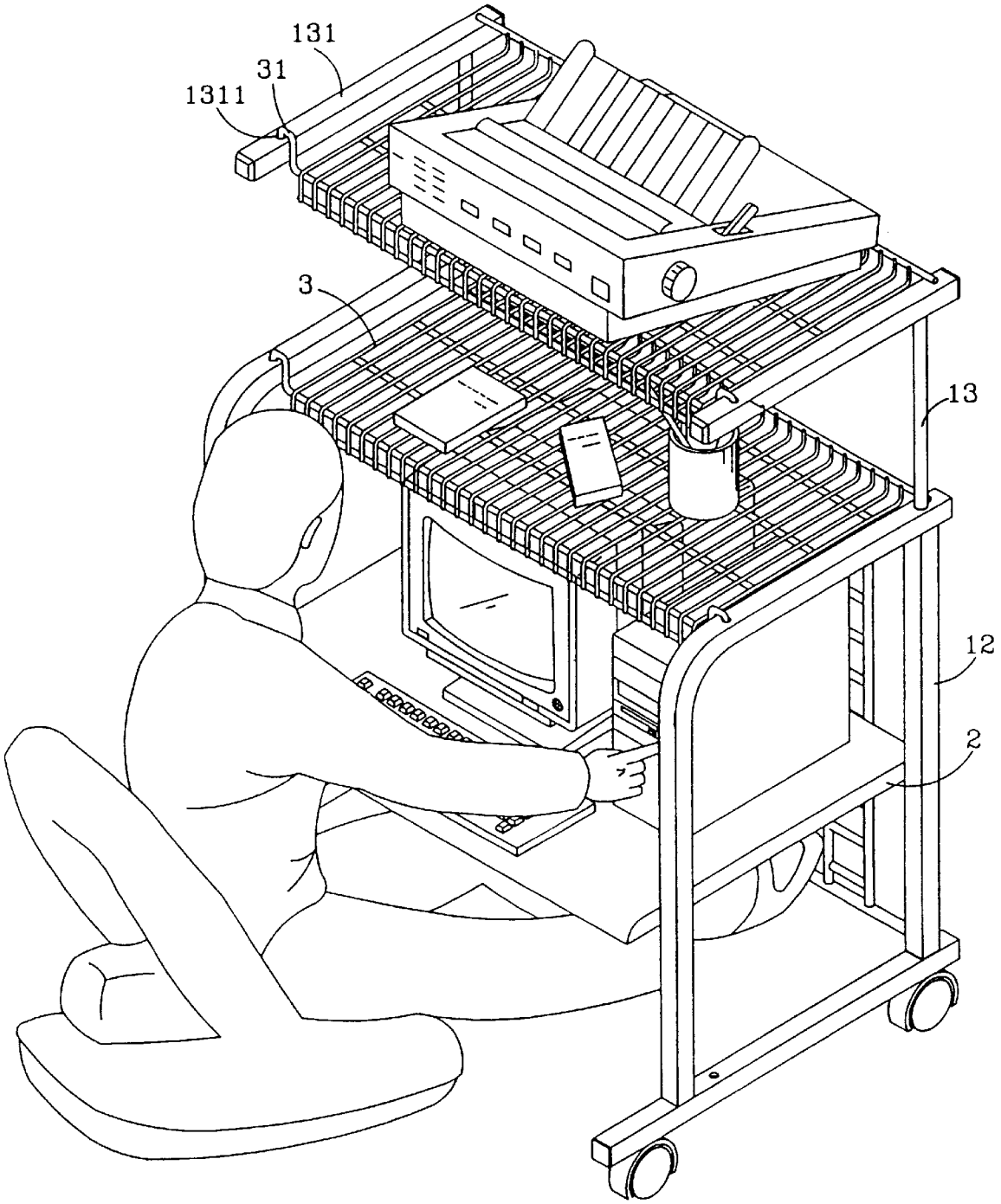
FIG. 10 illustrates a third example of the subject matter in application.

As illustrated in FIG. 10, when the subject matter of desk plate (2) is lowered below an appropriate level, a placement basket (3) can be put onto the leg racks (11) to increase the placement space.

Summing up, with the capability to achieve the subject purposes, the subject matter, which has not yet been displayed before the subject application, is a novel creation with applicability and industrial utility that will fully satisfy the qualifications for a patent right, hence this application is filed in accordance with the Patent Law to protect the subject inventor's rights and interests. Your favorable consideration shall be appreciated.

It is hereby declared that the above description, covering only the preferred embodiment of the subject matter, should not be based to limit or restrict the subject claim, and that all equivalent structural and/or configurational variations and/or modifications easily conceivable to anyone skilled in the subject art, and deriving from the subject description with drawings herein shall reasonably be included in the intent of the subject claim.

I claim:

1. A computer desk comprising:

a skeleton frame, a desk plate, on each of two sides of the skeleton frame being respectively located a leg rack that is able to rotate freely around a radial shaft lever and a transverse fixing lever to fix a distance between the two radial shaft levers, at each of a front portion of left and right sides of the desk plate being an adjustable bolt hook to be hooked in an adjustable bolt hole on the leg rack, and at a rear portion of the desk plate being an arched hook set to be hooked onto the transverse fixing lever, the arched hook of the desk plate being hooked onto the transverse fixing lever, so the adjustable bolt hook of the desk plate can be hooked in a pair of the adjustable bolt holes on the leg racks, thus to form a computer desk that is conveniently assembled, easily folded, and its height easily adjustable to suit a height of a user, and a telescopic lever extending into the radial shaft lever for adjusting a vertical height of a placement lever by lifting or lowering the telescopic lever and by pushing an inverted U-shaped piece extending into a fixing hole at a back of the radial shaft lever by a catch pin contained inside the telescopic lever.

2. The computer desk, as recited in claim 1, wherein on the transverse fixing lever is at least one support ladder for supporting the rear portion of the desk plate, so as to adjust the height of the desk plate by hooking in the adjustable bolt holes at the front portion of the desk plate.

3. The computer desk, as recited in claim 1, wherein the arched hook set of the desk plate is a jut or adjustable bolt, so that the arched hook set is easily removed from the transverse fixing lever, after the arched hook set is hooked onto the transverse fixing lever.

* * * * *